US011771255B2

(12) United States Patent
Wiriath et al.

(10) Patent No.: US 11,771,255 B2
(45) Date of Patent: Oct. 3, 2023

(54) CURTAIN ROD ASSEMBLY

(71) Applicants: Commonwealth Home Fashions Inc., Montreal (CA); YuYao City Yisheng Metal Products Co., Ltd., YuYao (CN)

(72) Inventors: Maxime Wiriath, Montreal (CA); Gaofeng Wang, YuYao (CN); Xiang Liu, YuYao (CN); Zhimin Jia, YuYao (CN)

(73) Assignees: Commonwealth Home Fashions Inc., Montreal (CA); YuYao City Yisheng Metal Products Co., Ltd., YuYao (CN)

( * ) Notice: Subject to any disclaimer, the term of this patent is extended or adjusted under 35 U.S.C. 154(b) by 0 days.

(21) Appl. No.: 17/101,794

(22) Filed: Nov. 23, 2020

(65) Prior Publication Data

US 2021/0153681 A1 May 27, 2021

(30) Foreign Application Priority Data

Nov. 23, 2019 (CN) ..... 201922039421.6

(51) Int. Cl.
*A47H 1/14* (2006.01)
*A47H 1/142* (2006.01)

(52) U.S. Cl.
CPC ..... *A47H 1/142* (2013.01)

(58) Field of Classification Search
CPC .... A47H 1/142; A47H 1/02; A47H 2001/006; A47H 2001/0205; A47H 2001/0215
See application file for complete search history.

(56) References Cited

U.S. PATENT DOCUMENTS 586,080 A * 7/1897 Thompson ..... A47G 25/0692 211/16
823,807 A * 6/1906 Peters ..... A47G 25/0685 211/96
934,569 A * 9/1909 Quinlan et al. .... A47G 25/0685 211/99
1,117,771 A * 11/1914 Boehm ..... A47G 25/0692 248/251
1,242,849 A * 10/1917 Parris ..... A47G 25/0685 248/265

(Continued)

FOREIGN PATENT DOCUMENTS

DE 202018106882 U1 4/2020

OTHER PUBLICATIONS

Walmart—48 inch—120 inch Adjustable Total Blackout Drapery Rod with Knob Finial in Nickel (Oct. 9, 2020); https://www.walmart.com/ip/48-Inch-to-120-Inch-Adjustable-Total-Blackout-Drapery-Rod-with-Knob-Finial-in-Nickel/518835423.

(Continued)

*Primary Examiner* — Ko H Chan

(57) ABSTRACT

A curtain rod assembly in which the two ends of the rod have both an elbow component that can turn inwardly toward a wall when the rod is fixed above a window and also a straight component that extends beyond the elbow component and upon which a finial can be mounted. The curtain rod assembly can thus have finial ends that extend beyond a hung curtain but can also allow the outer edges of the hung curtain panels to hang closely against the wall on either side of the window, thereby preventing or effectively reducing light from leaking past the curtain.

10 Claims, 4 Drawing Sheets

(56) References Cited

U.S. PATENT DOCUMENTS

| | | | | |
|---|---|---|---|---|
| 2,923,013 | A * | 2/1960 | Wasserman | F16B 9/052 403/384 |
| 5,170,974 | A * | 12/1992 | Ruggiero | A47K 3/38 160/124 |
| 5,561,870 | A * | 10/1996 | Hertel | A47K 3/38 24/339 |
| 7,024,706 | B2 * | 4/2006 | Hess | A47K 3/38 4/557 |
| 7,076,815 | B2 * | 7/2006 | Orpilla | A47K 3/38 4/558 |
| 7,926,127 | B2 * | 4/2011 | Barrese | A47K 3/38 4/610 |
| 8,214,938 | B2 * | 7/2012 | Hanley | A47K 3/38 248/261 |
| 8,341,775 | B2 * | 1/2013 | Didehvar | A47K 3/38 4/558 |
| 8,701,740 | B2 * | 4/2014 | Navarro | A47H 1/03 160/335 |
| 8,814,114 | B2 * | 8/2014 | Baines | E06B 7/28 248/265 |
| 10,092,126 | B2 | 10/2018 | Baines | |
| 10,861,623 | B2 * | 12/2020 | Niemer | H02G 3/0481 |
| 11,006,786 | B1 * | 5/2021 | Daniels | A47K 10/10 |
| 2007/0090244 | A1 * | 4/2007 | Goldstein | A47H 1/102 248/252 |
| 2015/0114578 | A1 | 4/2015 | Baines | |
| 2015/0265086 | A1 | 9/2015 | Hanley et al. | |
| 2017/0079458 | A1 * | 3/2017 | Engell | A47H 1/142 |
| 2018/0132646 | A1 | 5/2018 | Montanaro | |
| 2020/0352380 | A1 * | 11/2020 | Yu | A47H 5/0325 |

OTHER PUBLICATIONS

Wayfair—Philip Decorative Room Darkening Single Curtain Rod (Oct. 9, 2020); https://www.wayfair.com/decor-pillows/pdp/sun-zero-philip-decorative-room-darkening-single-curtain-rod-tdco1049.html.

* cited by examiner

Fig. 1
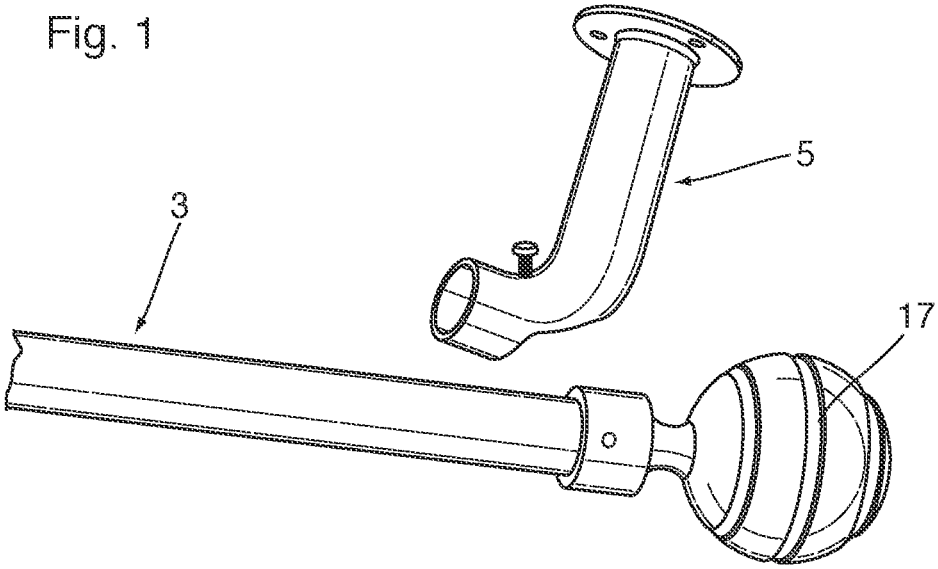
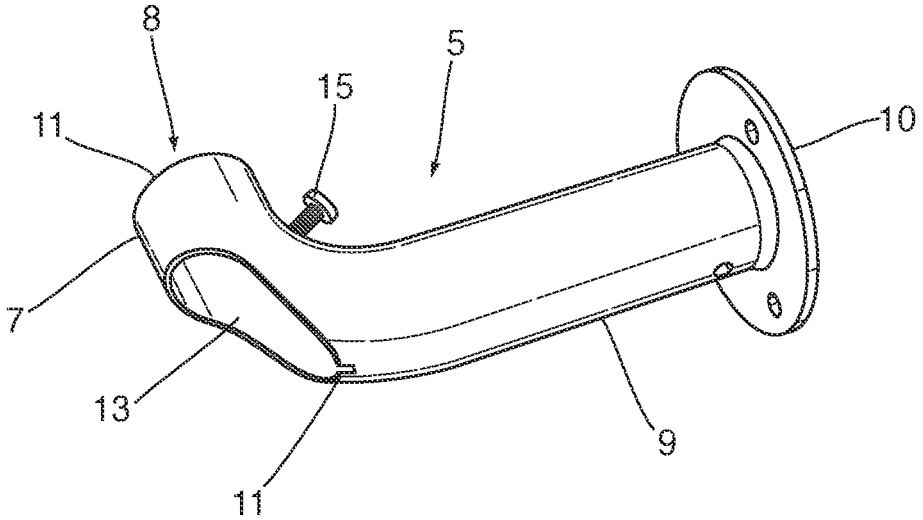
Fig. 2

CURTAIN ROD ASSEMBLY

RELATED APPLICATION

This application claims priority to Chinese application No. 201922039421.6, filed Nov. 23, 2019. The disclosure of which is herein incorporated by reference in its entirety.

FIELD

The present subject matter relates to drapery hardware. More specifically, the disclosure relates to a novel curtain rod assembly.

INTRODUCTION

Curtains and drapes can be hung from curtain rods in a number of different ways, including with rings, tabs, or a seemed pocket. One popular style uses grommets (or eyelets). Typically, two drapery panels are inserted over the left and right halves of a curtain rod with successive grommets passing in alternate directions so that the drapery panels undulate over the rod in a corrugated fashion, allowing them to be easily opened and closed.

The drapery rod is typically cylindrical, often being formed of two telescoping sections so that it can be extended to different lengths so as to cover windows of differing widths. The two ends of the drapery rod typically are covered with decorative finials that can have a variety of shapes.

The curtain rod can be mounted to a wall above a window typically by means of two or three brackets—for example, one bracket near each end and one bracket in the center, such that left and right drapery panels can be pulled open or pulled closed. The outermost edges of the panels are typically anchored to the ends of the rod by means of the outer-most grommets being blocked by the end brackets that hold the rod in position.

While this general configuration is popular, it usually suffers from light penetration at the two outer edges of the drapery panels. Such light penetration can be a problem for users who want a "black-out" curtain, which is to say a curtain that is intended to stop any light from entering a room from outside the window.

It is known to hang curtains from rods that have a right angled elbow at either ends so that the curtain can be pushed against the wall on either side of the window and thereby prevent or effectively reduce any light penetration. In some cases, the elbows include flanges that mount to a wall. However, a simple elbow does not provide any anchoring for the outer edge of the curtain panel, and does not accommodate a decorative finial.

SUMMARY

According to one aspect of the present disclosure, a curtain rod assembly is provided in which the two ends of the rod have both an elbow component that can turn inwardly onto a wall when the rod is fixed above a window and also a straight component that extends beyond the elbow component and upon which a finial can be mounted. Thus, a curtain rod is provided that has finial ends but that also allows the outer edge of each curtain panel to hang closely against the wall on either side of a window thereby preventing or effectively reducing light from leaking past the curtain.

In one example, the present curtain rod is based on a conventional straight rod having finials mounted or mountable at either ends. The rod is modified by mounting tubular elbow sections on the straight rod near the finial ends. The tubular elbow sections are dimensioned to fit closely over the straight rod with the rod passing through an opening in the side wall of the elbow section.

According to another example, the present curtain rod assembly is based on a U-shaped black-out curtain rod having integral elbow portions at each end. The rod is modified by mounting straight tubular sections near the elbows. The straight tubular sections are dimensioned to fit closely over the rod with the terminal leg of the rod's integral elbow passing through an opening in the side wall of the straight tubular section.

According to another aspect of the disclosure, there is provided a modification kit for a conventional straight curtain rod having finials mounted or mountable at either ends. The kit comprises a pair of tubular elbow sections that can be mounted on the straight rod near the finial ends. The tubular elbow sections are dimensioned to fit closely over the straight rod with the rod passing through an opening in the side wall of the elbow section. Once the pair of tubular elbow sections are mounted to it, the conventional straight curtain rod has two ends that have both an elbow component that can turn inwardly onto a wall when the rod is fixed above a window and also a straight component that extends beyond the elbow component and upon which a finial can be mounted. Thus, a curtain rod is provided that has finial ends but that also allows the outer edge of each curtain panel to hang closely against the wall on either side of a window thereby preventing or effectively reducing light from leaking past the curtain.

According to another aspect of the disclosure, there is provided a modification kit for a U-shaped black-out curtain rod having integral elbow portions at each end. The kit comprises a pair of straight tubular sections that can be mounted to the rod near the elbows. The straight tubular sections are dimensioned to fit closely over the rod. Once the pair of straight tubular sections are mounted to it, the U-shaped black-out curtain rod has two ends that have both an elbow component that can turn inwardly onto a wall when the rod is fixed above a window and also a straight component that extends beyond the elbow component and upon which a finial can be mounted. Thus, a curtain rod is provided that has finial ends but that also allows the outer edge of each curtain panel to hang closely against the wall on either side of a window thereby preventing or effectively reducing light from leaking past the curtain.

DRAWINGS

In order that the claimed subject matter may be more fully understood, reference will be made to the accompanying drawings, in which:

FIG. 1 is a side perspective view of an example of a portion of a curtain rod assembly according to the present subject matter with the central component and one of the end components of the curtain rod assembly shown separated.

FIG. 2 is an alternative side perspective view of one of the end components of the curtain rod assembly of the curtain rod assembly of FIG. 1.

DESCRIPTION OF VARIOUS EMBODIMENTS

Figure 3:
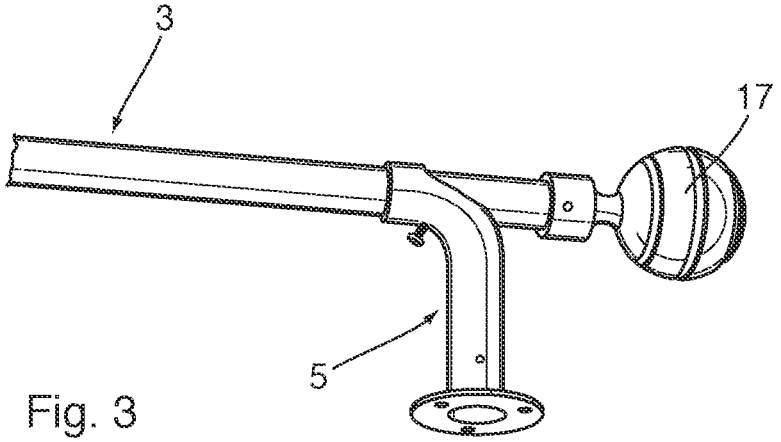
FIG. 3 is a side perspective view of curtain rod assembly portion according to FIG. 1 with the components mounted together.

In the following description, specific details are set out to provide examples of the claimed subject matter. However, the embodiments described below are not intended to define or limit the claimed subject matter. It will be apparent to those skilled in the art that many variations of the specific embodiments may be possible within the scope of the claimed subject matter.

Referring to FIG. 1, there is shown a portion of a curtain rod assembly according to one embodiment of the present subject matter. The curtain rod assembly includes a central component 3 and an elbow component 5, which are shown separated.

For example, the central component can include a curtain rod. The rod can be straight. The rod can be a telescoping rod. The telescoping rod can have a plurality of sections. The sections of the telescoping rod can be configured in a telescoping arrangement such that a first portion of the telescoping rod is configured to slide into a second portion of the telescoping rod and so on. For example, the curtain rod can define an axial direction. For example, in use, when a curtain is mounted on the curtain rod, the curtain can be slid along the axial direction.

The elbow component 5 of FIG. 1 is further shown in FIG. 2. The elbow component 5 includes a first section 7, a second section 9 and an arc section 11 positioned between the first section 7 and the second section 9. The elbow component 5 further includes a first end 8 positioned on the first section 7. The first end 8 of the elbow component 5 is adapted to receive a portion of the central component 3. The elbow component 5 further includes a second end 10 positioned on the second section 9. The second end 10 is adapted to mount the elbow component 5 to a support surface when installing the rod assembly.

The first end 8 of the elbow component 5 defines an opening 11 dimensioned to receive the central component 3. For example, the opening 11 can snugly fit the central component 3. The opening 11 defines a channel within the first section 7. The channel can receive and fit closely over part of the central component. The sidewall of the arc section 11 defines an opening 13 to allow the central component 3 to pass through the elbow component. An adjuster 15 (e.g. a screw) can be positioned on a surface opposing the opening 13 for fixing the central component 3 within the channel of the first section 7. The adjuster 15 can further provide a snug fit between the central component 3 and the elbow component 5.

Figure 4:
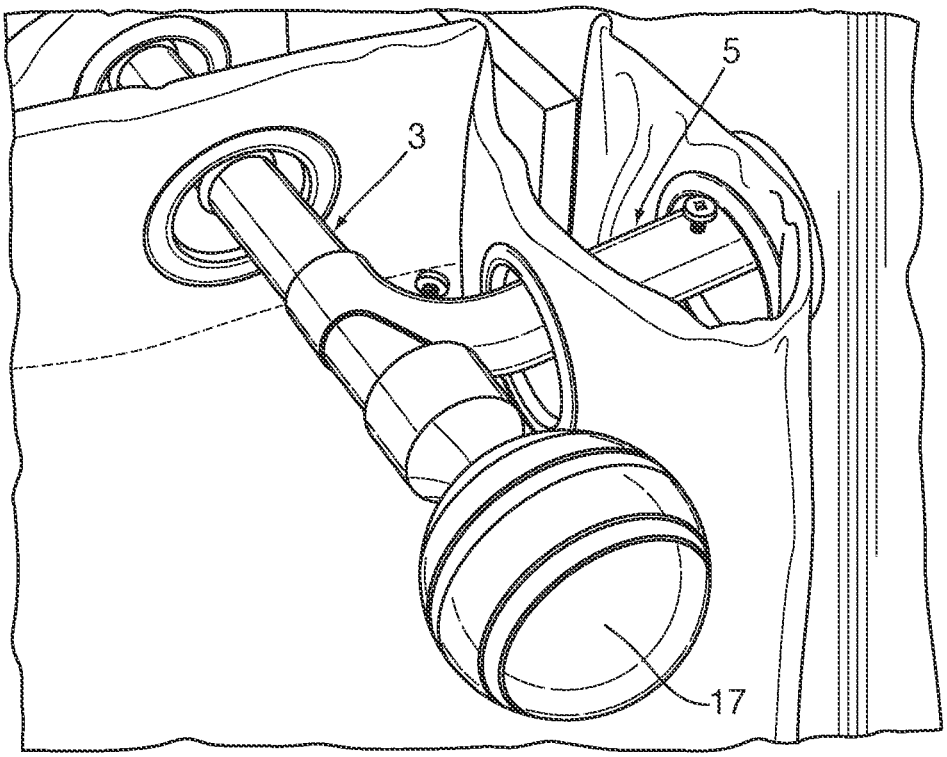
FIG. 4 is a perspective view of the curtain rod assembly portion of FIG. 1 installed with a grommet-style curtain hanging therefrom.

Referring to FIG. 3, the elbow component 5 is shown mounted on the central component 3. This can be obtained by passing the central component 3 through the elbow component 5 via the opening 11. Then, the central component 3 passes through the channel of the first section 7 and exits the elbow component 5 through the opening 13. For example, the structure of the elbow component advantageously allows it to blend with the shape of the central component 3 such that both of them can accommodate a same grommet-style curtain. FIG. 4 shows a grommet-style curtain installed on the curtain rod assembly, including the central component 3 and the elbow component 5.

As shown in FIGS. 1, 3 and 4, a finial 17 can be mounted on the portion of central component 3 that extends beyond the elbow component. As shown in FIG. 4, a curtain rod is provided, such that it a finial end but that also allows the outer edge of a curtain panel to hang closely against a wall on one side of a window thereby preventing or effectively reducing light from leaking past the curtain.

Furthermore, a curtain rod can be provided, the curtain rod having finial ends and allowing outer edges of a curtain panel to hang closely against a wall on either side of a window thereby preventing or effectively reducing light from leaking past the curtain.

Figure 5:
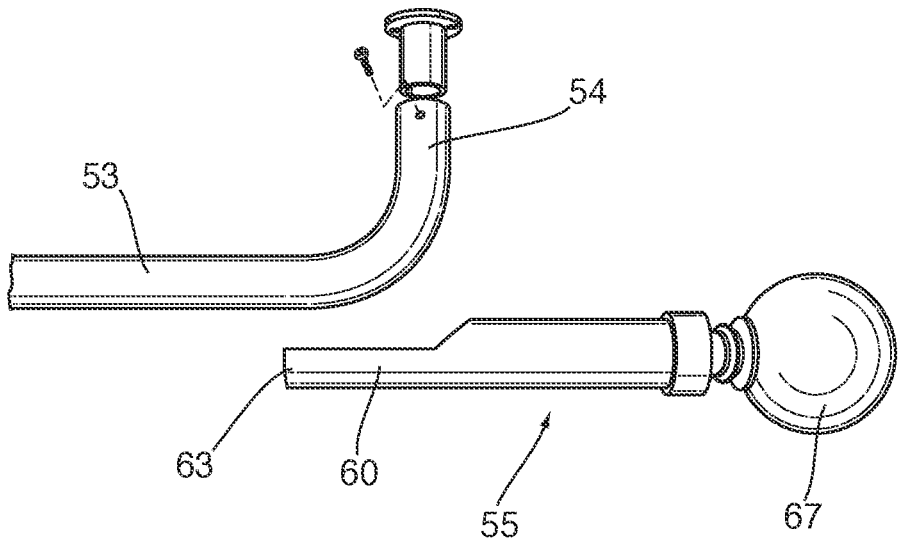
FIG. 5 is a perspective view of another example of a portion of a curtain rod assembly according to the present subject matter with the central component and one of the end components of the curtain rod assembly shown separated.

Referring to FIG. 5, there is shown a portion of a curtain rod assembly according to one embodiment of the present subject matter. The curtain rod assembly includes a central component 53 and a straight tubular section 55, which are shown separated.

The central component 53 includes a U-shaped black-out curtain rod having integral elbow portions at one end. For example, the U-shaped black-out curtain rod can also have an integral elbow portions 54 at each end. The U-shaped rod can be modified by mounting straight tubular sections near the elbows. For example, the straight tubular sections are dimensioned to fit closely over the U-shaped rod with the terminal leg of the rod's integral elbow passing through an opening in the side wall of the straight tubular section.

Figure 6:
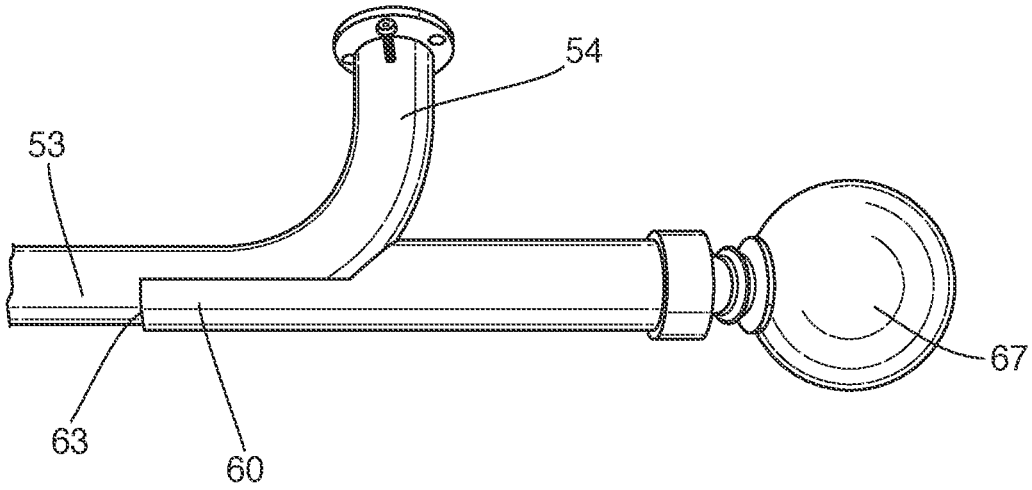
FIG. 6 is a perspective view of another example of a side perspective view of the curtain rod assembly of FIG. 5 with the components mounted together.

An embodiment of a straight tubular section 55 is shown in FIGS. 5 and 6. The straight tubular section 55 includes a first end 60 defining a channel 63 through the tubular section. For example, the surface of the channel 63 can be mounted over a portion of the central component 53 proximate the elbow portion 54. For example, the channel 63 can be open at the first end 60. This allows attachment of the straight tubular section 55 directly on central component 53 proximate the elbow portion without passing it through the elbow portion. A finial 67 can be mounted on a second end of the straight tubular section 55.

Figure 7:
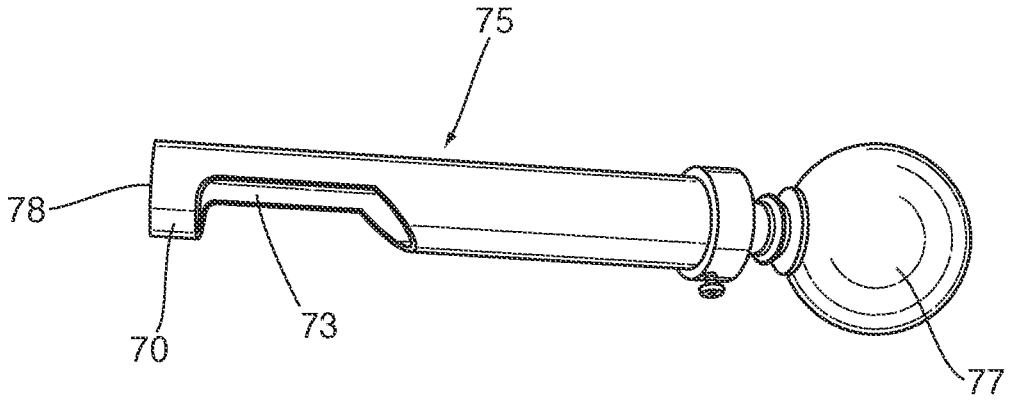
FIG. 7 is a side perspective view of one of the end components of a curtain rod assembly similar to the curtain rod assembly of FIG. 5.
Figure 8:
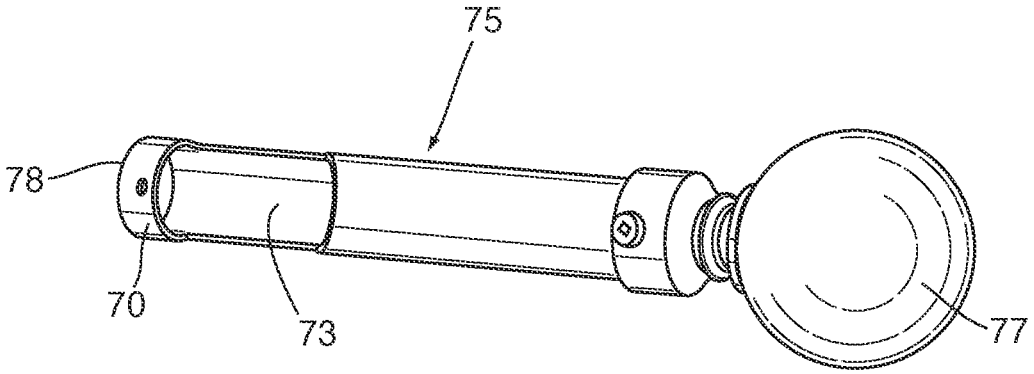
FIG. 8 is a top perspective view of the curtain rod assembly end component of FIG. 7.

Another embodiment of a straight tubular section 75 is shown in FIGS. 7 and 8. The straight tubular section 75 includes a first end defining an opening 78 and a ring section 70 for securing the straight tubular section to the U-shaped rod. The ring section can prevent the straight tubular section from being falling off the central component when attachment between the straight tubular section and the central component is loose.

The ring section 70 leads to a channel 73 defined through the tubular section 75. A portion of the channel can be open to facilitate mounting of the straight tubular section 75 over a U-shaped curtain rod. For example, the straight tubular section 75 can be mounted over a U-shaped rod by passing the ring portion through the elbow portion of the rod. A finial 77 can be mounted on a second end of the straight tubular section 75.

The curtain rod, the elbow component, the straight tubular section and the finial may be made from any suitable materials such as plastics, metals (e.g. aluminum, steel, etc.), polymeric materials (e.g. polyethylene, polypropylene, nylon and the like).

According to one embodiment, a modification kit for a conventional straight curtain rod having finials mounted or mountable at either ends is provided. The kit can include a pair of tubular elbow sections that can be mounted on the straight rod near the finial ends. The tubular elbow sections are dimensioned to fit closely over the straight rod with the rod passing through an opening in the side wall of the elbow section. Once the pair of tubular elbow sections are mounted to it, the conventional straight curtain rod has two ends that have both an elbow component that can turn inwardly onto a wall when the rod is fixed above a window and also a straight component that extends beyond the elbow component and upon which a finial can be mounted. Thus, a curtain rod is provided that has finial ends but that also allows the outer edge of each curtain panel to hang closely against the wall on either side of a window thereby preventing or effectively reducing light from leaking past the curtain.

According to one embodiment, a modification kit for a U-shaped black-out curtain rod having integral elbow portions at each end is provided. The kit includes a pair of straight tubular sections that can be mounted to the rod near the elbows. The straight tubular sections are dimensioned to fit closely over the rod. Once the pair of straight tubular sections are mounted to it, the U-shaped black-out curtain rod has two ends that have both an elbow component that can turn inwardly onto a wall when the rod is fixed above a window and also a straight component that extends beyond the elbow component and upon which a finial can be mounted. Thus, a curtain rod is provided that has finial ends but that also allows the outer edge of each curtain panel to hang closely against the wall on either side of a window thereby preventing or effectively reducing light from leaking past the curtain.

It will be appreciated by those skilled in the art that although the above alternative embodiments have been described in some detail many modifications may be practiced without departing from the claimed subject matter.

The invention claimed is:

1. A hung curtain arrangement installed above an exterior window of a wall, the curtain arrangement comprising:

a curtain, having left and right panels which each have an outer side edge, and a curtain rod assembly for hanging the curtain above the window, the curtain rod assembly having:

a generally straight elongate inner portion being at least as long as the width of the window, and two outer wall mounting portions, one on either side of the elongate inner portion, the outer wall mounting portions extending parallel to each other and transverse to the elongate inner portion, and each terminating with a fixation plate for mounting the curtain rod assembly to the wall, and two generally straight outermost end portions, one on either side of the elongate inner portion, the outermost end portions extending axially from the inner portion beyond the two outer wall mounting portions, and each terminating with a finial, at least one of either the two outer wall mounting portions or the two outermost end portions being removably connectable to the elongate inner portion, wherein the curtain rod assembly is mounted to the wall above the window, with the curtain hanging from the elongate inner portion and also hanging from the two outer wall mounting portions, with the outer side edges of the left and right curtain panels held closely against the wall on either side of the window to prevent or effectively reduce light from leaking past the curtain, and with the two outermost end portions extending outwardly of the curtain so that the finial of each outermost end portion is visible.

2. The hung curtain arrangement of claim 1, wherein the two outer wall mounting portions are tubular and elbow shaped, with two generally straight orthogonal ends and an intermediate arc section.

3. The hung curtain arrangement of claim 2, wherein each of the two elbow shaped outer wall mounting portions has an end opening and sidewall opening proximal the arc section that allow the elongate inner portion to pass therethrough.

4. The hung curtain arrangement of claim 3, wherein the two elbow shaped outer wall mounting portions are removably connectable to the elongate inner portion with a snug fit.

5. The hung curtain arrangement of claim 4, wherein the curtain has rings or eyelets for hanging from the curtain rod assembly and the two elbow shaped outer wall mounting portions blend with the shape of the elongate inner portion to accommodate the same rings or eyelets of the curtain.

6. The hung curtain arrangement of claim 5, wherein each of the two elbow shaped outer wall mounting portions further comprises an adjuster positioned on a surface opposing the sidewall opening of the arc section for adjusting the connection between the wall mounting portion and the elongate inner portion.

7. A curtain rod assembly for hanging a curtain above a window of an exterior wall, the curtain having left and right panels with rings or eyelets for hanging from the curtain rod assembly, each panel having an outer edge, the curtain rod assembly comprising:

a generally straight elongate inner portion being at least as long as the width of the window, and two outer wall mounting elbow portions, one on either side of the elongate inner portion, that blend with the shape of the elongate inner portion to accommodate the same rings or eyelets of the curtain, the outer wall mounting portions each having an end opening and sidewall opening that allow the elongate inner portion to pass therethrough, each outer wall mounting portion extending parallel to each other and transverse to the elongate inner portion, and terminating with a fixation plate for mounting the curtain rod assembly to the wall, and two generally straight outermost end portions, one on either side of the elongate inner portion, the outermost end portions extending axially from the inner portion, beyond the two outer wall mounting portions, and each terminating with a finial, with the two outer wall mounting elbow portions being removably connectable to the elongate inner portion with a snug fit, such that the curtain rod assembly can be mounted to the wall above the window, with the curtain hanging from the elongate inner portion and also hanging from the two outer wall mounting portions, with the outer edges of the left and right curtain panels held closely against the wall on either side of the window to prevent or effectively reduce light from leaking past the curtain, and with the two outermost end portions extending outwardly of the curtain so that the finial of each outermost end portion is visible.

8. The curtain rod assembly of claim 7, wherein the two outer wall mounting portions are tubular, with two generally straight orthogonal ends and an intermediate arc section.

9. The curtain rod assembly of claim 8, wherein the sidewall opening is proximal the arc section.

10. A pair of wall mounting components for a curtain rod assembly to hang a curtain above a window of an exterior wall, the curtain rod assembly having a generally straight elongate inner portion being at least as long as the width of the window and two generally straight outermost end portions, one on either side of the elongate inner portion, each of the two outermost end portions extending axially from the inner portion and terminating with a finial, each of the wall mounting components comprising:

a tubular elbow with two generally straight ends and an intermediate arc section, the elbow being dimensioned to fit closely over the elongate inner portion and shaped to blend with the shape of the elongate inner portion, the elbow having an open end and a sidewall opening in the arc section that allow the elongate inner portion to pass therethrough, the elbow also having a fixation plate at the other end for mounting the curtain rod assembly to the wall, each of the outer wall mounting components being removably connectable to the elongate inner portion with a snug fit, with the outer wall mounting components extending parallel to each other and transverse to the elongate inner portion, such that the curtain rod assembly can be mounted to the wall above the window, with the curtain hanging from the elongate inner portion and also hanging from the two outer wall mounting portions, with the outer edges of the left and right curtain panels held closely against the wall on either side of the window to prevent or effectively reduce light from leaking past the curtain, and with the two outermost end portions extending outwardly of the curtain so that the finial of each outermost end portion is visible.

* * * * *